US005791893A

United States Patent [19]

Charles, Sr. et al.

[11] Patent Number: 5,791,893

[45] Date of Patent: Aug. 11, 1998

[54] BURNER WITH CERAMIC INSERT

[75] Inventors: John G. Charles, Sr., Tyler, Tex.; Eugene D. Daddis, Jr., Nedrow; Benny P. DiMarco, Cicero, both of N.Y.

[73] Assignee: Carrier Corporation, Syracuse, N.Y.

[21] Appl. No.: 578,777

[22] Filed: Dec. 26, 1995

[51] Int. Cl.[6] ..... F23D 14/04; F23D 14/16

[52] U.S. Cl. ..... 431/328; 431/326

[58] Field of Search ..... 431/7, 326, 328, 431/346, 354, 355, 114; 126/92 AC

[56] References Cited

U.S. PATENT DOCUMENTS

| | | | |
|---|---|---|---|
| 1,222,922 | 4/1917 | Bone et al. | 431/7 |
| 1,227,277 | 5/1917 | Land | 431/346 |
| 1,281,300 | 10/1918 | Cross | 431/354 |
| 1,368,120 | 2/1921 | Cole | 431/346 |
| 2,369,235 | 2/1945 | Jaros | 431/346 |
| 2,775,294 | 12/1956 | Schwank | 431/346 |
| 3,208,247 | 9/1965 | Weil et al. | 431/328 |
| 3,245,458 | 4/1966 | Patrick et al. | 431/346 |
| 3,807,940 | 4/1974 | Juricek | 431/346 |
| 3,912,443 | 10/1975 | Ravault et al. | 431/328 |
| 3,947,233 | 3/1976 | Sundberg | 431/328 |
| 4,081,958 | 4/1978 | Schelp | 60/39.51 R |
| 4,257,757 | 3/1981 | Ashe et al. | 431/328 |
| 4,311,447 | 1/1982 | Rackely et al. | 431/328 X |
| 4,608,012 | 8/1986 | Cooper | 431/328 |
| 4,643,667 | 2/1987 | Fleming | 431/7 |
| 4,732,559 | 3/1988 | Pear, II et al. | 431/346 |
| 4,917,599 | 4/1990 | Hasselmann | 431/328 |
| 5,000,676 | 3/1991 | Fialla | 431/354 |
| 5,108,284 | 4/1992 | Gruswitz | 431/354 |
| 5,147,201 | 9/1992 | Xiong | 431/7 |
| 5,244,381 | 9/1993 | Cahlik | 431/171 |
| 5,470,222 | 11/1995 | Holowczak et al. | 431/7 |

FOREIGN PATENT DOCUMENTS

| | | | |
|---|---|---|---|
| 005225 | 4/1977 | Japan | 431/22 |

*Primary Examiner*—Carl D. Price

[57] ABSTRACT

A porous silicon carbide insert is located in the burner and defines the burner head. This provides a larger area for the flame to attach to the burner head since the porous insert causes the gas/air mixture to flow from the entire burner head. A more stable flame results and the flame is unable to travel back into the burner venturi through the insert.

2 Claims, 1 Drawing Sheet

BURNER WITH CERAMIC INSERT

BACKGROUND OF THE INVENTION

Gas appliances, such as furnaces may use an inshot type of gas burner nozzle. This type of nozzle operates by directing fuel gas under pressure to a port with the gas going past an annular opening which causes the aspiration of atmospheric air with the air-fuel mix passing into the venturi of the burner nozzle. In some constructions, a burner head insert made of sintered or powdered metal having outlet openings is mounted in the outlet end of the tube. In operation, gas is injected into the inlet end of the nozzle, entraining air into the nozzle with it. This primary air/gas mix flows through the tube to the burner head or flame retention insert. The primary air/gas mix passes through the insert and burns as it exits the insert forming a cone of flame projecting from the outer face. Secondary air flows around the outside of the venturi tube and is entrained in the burning mixture around the outside of the insert in order to complete combustion.

Some of the problems associated with conventional inshot burner designs are ignition, flame stability and noise. Ignition problems can arise when the ignition location is critical. The velocity of the primary air/gas flow from the insert is often greater than the flame speed. Under this condition, the flame lifts off from the burner insert, i.e. the flame begins to burn in mid air at a location spaced from the outer face of the flame retention insert. Flame liftoff is a major cause of the noise associated with the operation of inshot burner nozzles.

If the velocity of the air/gas mixture is too slow when compared to the flame speed, flashback can occur. Flashback is the burning of the gas within the burner nozzle itself. This condition can cause overheating and deterioration of the nozzle.

Various flame retention or burner head inserts have been designed in the past in an attempt to achieve better flame stability and reduction of noise. One known insert has a central opening surrounded by a toothed perimeter or sunburst. The air/gas mixture passing through the central opening of the insert forms an inner flame cone, while the air/gas mixture passing through the sunburst and the central opening are nearly the same. Another known insert has a central opening surrounded by a series of small holes. Again, the velocities of air/gas flow through the small holes and the central opening are nearly the same. Flame instability, particularly liftoff with its attendant noise, are associated with both of these prior art insert designs.

In most appliances, the inshot nozzles are arranged side-by-side and provision is made for cross ignition. One conventional nozzle has two diametrically opposed, narrow plenum chambers that extend radially from the outlet end of the venturi tube. Each plenum chamber has an outlet along its front or leading edge and along its side edges. Gas escaping from the side edges of the plenums of one nozzle burns and thereby ignites the gas escaping the plenums of the adjacent nozzles. With this conventional construction, it has been difficult to achieve uniform and consistent cross ignition, particularly at low gas input rates.

SUMMARY OF THE INVENTION

A porous ceramic burner insert is provided so as to provide a large area for the flame to attach to the burner head. This, in turn, makes for a more stable flame while the porous insert prevents the flame from traveling back into the burner venturi.

It is an object of this invention to increase burner efficiency.

It is another object of this invention to provide an improved inshot gas burner nozzle which is characterized by good flame stability and low operational noise.

It is a further object of this invention to provide a new flame retention insert for an inshot gas burner nozzle which makes it possible to control the velocity of gas flow through the insert in a manner which reduces the occurrence of flame liftoff and resulting noise.

It is another object of this invention to provide a uniform fuel/air mixture across the face of the burner.

It is an additional object of this invention to provide an improved gas burner nozzle which has consistent cross-ignition characteristics over varied gas input rates, and more particularly one that will consistently cross-ignite at low input rates.

It is another object of this invention to provide a less critical location for the ignition source.

It is a further object of this invention to reduce the amount of primary air. These objects, and others as will become apparent hereinafter, are accomplished by the present invention.

Basically, gaseous fuel flows through the burner and the porous ceramic insert where it is ignited. Because of the porosity of the insert, the igniter can be placed anywhere on the face of the insert and provide smooth, even ignition. The density of the porous ceramic insert holds the flame to the face of the insert and does not allow the burner flame to flash back on low line pressure.

DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
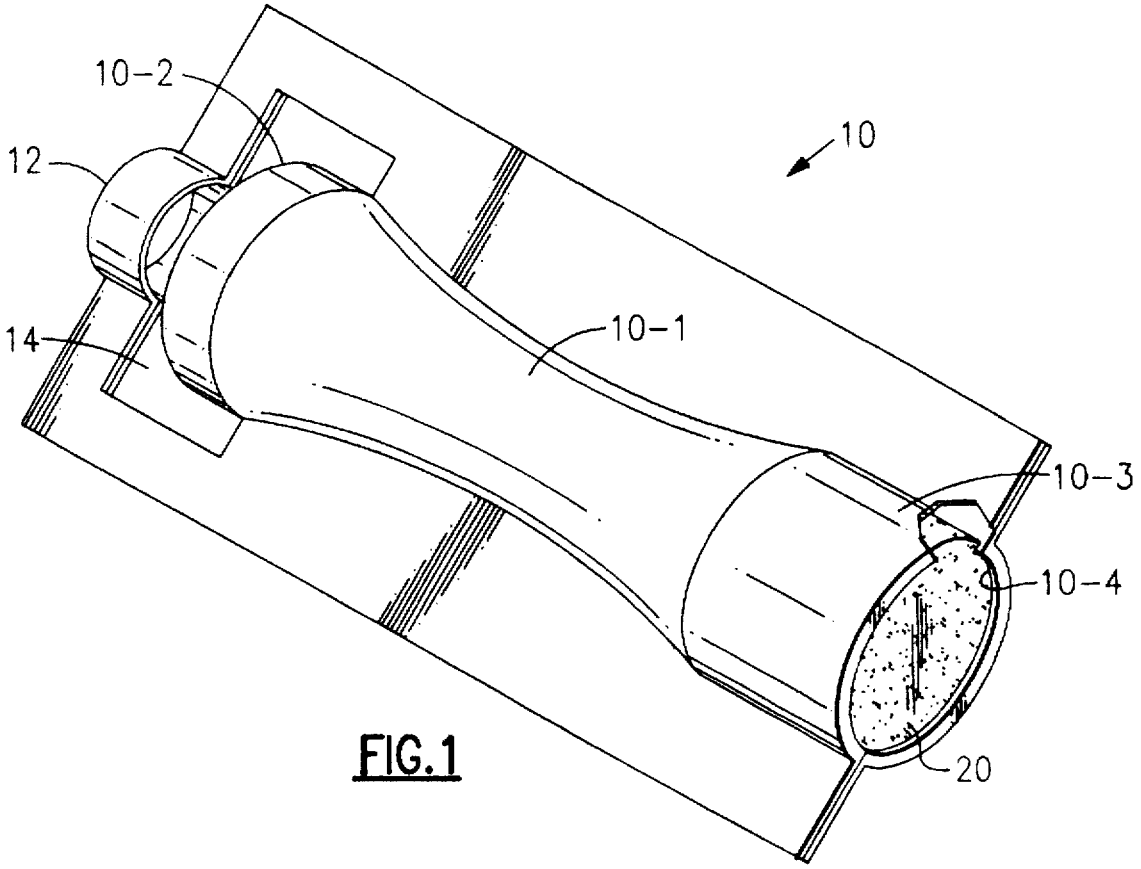
FIG. 1 is a pictorial view of the burner of the present invention.
Figure 2:
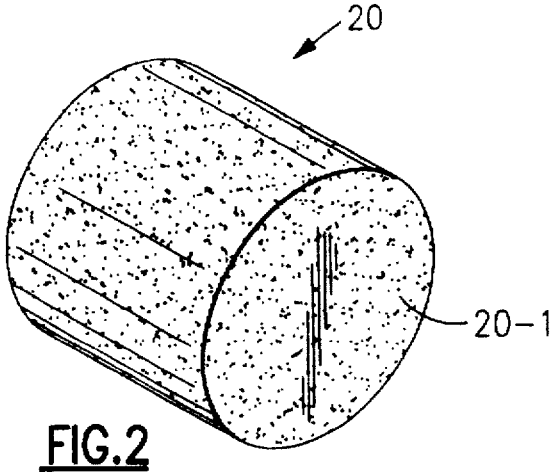
FIG. 2 is a pictorial view of the ceramic insert.

In FIG. 1, the numeral 10 generally designates the inshot burner nozzle employing the present invention. Nozzle 10 has a venturi tube 10-1 having a flared inlet end 10-2 and an outlet end or burner head 10-3. Port 12 is connected to the fuel gas supply and is spaced from inlet end 10-2 by annular gap 14. Cylindrical porous ceramic flame retention insert 20 is retained within burner head 10-3 by flange 10-4. The insert 20 is preferably a porous silicon carbide material having a porosity of twenty pores per inch. A suitable insert is cylindrical shaped with a diameter of 1.25 inches (32 mm) and a height of 0.8 inches (20 mm).A suitable porous silicon carbide material is approximately two thirds silicon carbide, a quarter alumina with the remainder silica and with a density of 0.30 to 0.50 gm/cc. Insert 20 allows the gas/air mixture to pass through with the entire face 20-1 being an outlet which results in a very even distribution of the gas/air mixture and a reduced velocity across the burner face 20-1. This should be contrasted with prior art designs where ignition location is very critical and if the igniter was not in the correct position, the gas/air mixture would not ignite. With insert 20, ignition can be achieved from any place on the burner face 20-1 while eliminating flash back at pressures as low as 0.5 inches of water and flame lift off from the burner.

In operation, a large inner flame cone is formed by burning the primary mix of air and gas passing through the porous openings of the insert 20. In a furnace, an outer cone of burning gas and secondary air surrounds the mantle and extends beyond the inner and outer cones of flame formed at the insert face 20-1. The low velocity flame mantle formed by the pores is effective to hold the flame an insert face 20-1 and reduces the occurrence of liftoff. Specifically, gaseous fuel such as natural gas, propane or butane is supplied under pressure to port 12 of burner 10. The gas supplied to port 12 passes annular opening or gap 14 aspirating atmospheric air which is drawn into burner 10. The fuel/air mixture passes through venturi tube 10-1 and into insert 20 which causes the fuel/air mixture to be distributed over the entire face 20-1 of the insert 20. This provides a larger area for the flame to attach to the burner head and a more stable flame while preventing the flame from traveling back into the burner venturi 10-1.

Although a preferred embodiment of the present invention has been described and illustrated, other changes will occur to those skilled in the art. It is therefore intended that the scope of the present invention is to be limited only by the scope of the appended claims.

What is claimed is:

1. An inshot burner nozzle comprising:

a venturi tube having an inlet for receiving gaseous fuel and atmospheric air and an enlarged outlet end;

a burner insert having an inlet side and an outlet side defining an outer face and supported within said enlarged outlet end for creating a desired flame pattern;

said burner insert comprising a porous ceramic silicon carbide material having a porosity of twenty pores per inch and a density of 0.30 to 0.50 grams per cubic centimeter such that said gaseous fuel and atmospheric air are distributed therein and emission of a gas/air mixture from said insert is at a slower velocity at said outer face of said insert than at said inlet side so as to provide a more stable flame due to the distribution.

2. The nozzle of claim 1 wherein said insert is 0.8 inches thick.

* * * * *